United States Patent [19]

Aiba et al.

[11] 4,242,196

[45] Dec. 30, 1980

[54] MASS PRODUCTION SYSTEM OF HIGHLY AROMATIC PETROLEUM PITCH

[75] Inventors: Takaaki Aiba, Iwaki; Ryoichi Takahashi, Tokyo; Takuji Hosoi, Kawashaki; Tutomu Konno, Tokyo, all of Japan

[73] Assignees: Kureha Kagaku Kogyo Kabushiki Kaisha, Tokyo; Sumikin Coke Co., Ltd, Wakayama; Sumitomo Metal Industries, Ltd., Osaka, all of Japan

[21] Appl. No.: 955,219

[22] Filed: Oct. 27, 1978

Related U.S. Application Data

[63] Continuation-in-part of Ser. No. 850,046, Dec. 6, 1977, abandoned, which is a continuation-in-part of Ser. No. 732,297, Oct. 14, 1976, abandoned.

[51] Int. Cl.³ ..... C10G 9/14

[52] U.S. Cl. ..... 208/40; 208/128; 208/130; 208/132

[58] Field of Search ..... 208/128, 130, 131, 78, 208/40, 132

[56] References Cited

U.S. PATENT DOCUMENTS

| | | | |
|---|---|---|---|
| 2,011,479 | 8/1935 | Forrester | 208/131 |
| 3,617,480 | 11/1971 | Keel | 208/131 |
| 3,928,170 | 12/1975 | Takahashi et al. | 208/128 |
| 3,956,101 | 5/1976 | Hara et al. | 208/128 |

*Primary Examiner*—Herbert Levine

*Attorney, Agent, or Firm*—Stevens, Davis, Miller & Mosher

[57] ABSTRACT

The mass production system disclosed herein provides a method for producing highly aromatic petroleum pitch, comprising, preheating a liquefied petroleum residuum to a temperature of 450°-520° C. by passing the same through a tubular heater for 0.5-15 minutes, feeding the preheated residuum into a reaction vessel, thermally cracking the same by introducing an inert gas heated to a temperature of 400°-2,000° C. through a heating furnace into the reaction vessel for direct contact with the residuum for 0.5-10 hours, and adjusting to be coincident the ratio of the number of feeding flow lines for the preheated residuum from the tubular heater into the reaction vessels to the total number of reaction vessels with the ratio of the charging time θC required for charging one reaction vessel with one feeding flow of preheated residuum to the total time θT required for carrying out one batch of the thermal cracking in one reaction vessel.

3 Claims, 7 Drawing Figures

MASS PRODUCTION SYSTEM OF HIGHLY AROMATIC PETROLEUM PITCH

This application is a continuation-in-part application of our copending application entitled "METHOD FOR THE CONTINUOUS THERMAL CRACKING TREATMENT OF HEAVY PETROLEUM OIL", Ser. No. 850,046, filed Dec. 6, 1977, which is in turn a continuation-in-part application Ser. No. 732,297, filed Oct. 14, 1976, for "METHOD FOR THE CONTINUOUS THERMAL CRACKING TREATMENT OF HEAVY PETROLEUM OIL", both now abandoned.

The present invention relates to a thermal cracking process of petroleum residues, and more particularly to a mass production system of a highly aromatic pitch suitable for use as a binder for manufacturing of coke.

In the specification of U.S. Pat. No. 3,928,170, a basic process for the liquid phase cracking aromatization of a petroleum residuum is disclosed, which comprises the steps of rapidly preheating a liquefied petroleum residuum to a temperature of from 450° to 520° C. by passing the same through a tubular heater for 0.5–15 minutes, feeding the thus preheated residuum into a reaction vessel and thermally cracking the same by introducing an inert gas heated to a temperature of 400°–2,000° C. through a heating furnace into the reaction vessel for direct contact with the residuum in the liquid phase for 0.5–10 hours thereby to form a hydrocarbon gas, an aliphatic hydrocarbon oil and a highly aromatic pitch.

As a result of the studies of the inventors of the present invention, it has found that the fulfillment of the following basic conditions of chemical engineering is necessary for the effective execution of the above-mentioned process in an industrial scale:

1. That the steady and continuous operation of the tubular heater be maintained throughout the whole production course. Because the interruption or fluctuation of the operation of the tubular heater not only brings a loss of the production efficiency but also is apt to raise a dangerous, so-called, coking problem.

2. That the steady and continuous operation of the heating furnace for heating the inert gas to a high temperature also be maintained the same as condition (1). In other words, it is necessary that the total flow rate of the heated inert gas which is generated from the heating furnace be maintained at a predetermined value throughout the period of operation.

In addition to fulfilling the above-mentioned conditions, the effective utilization of the total volume of the heated inert gas is required from an economical point of view.

3. As is described in the afore-mentioned U.S. patent, the degree of progress of the above-mentioned thermal degradation may be expressed by $k\theta$, in which k is a function of the temperature and the reaction rate constant determined on the supposition that the cracking is a reaction of the first order, and $\theta$ is the reaction time. For instance, when the pitch is considered to consist of very small particles of pitch unit, the reaction time $\theta$ for each pitch unit assumes its own definite value, and all the values are the same in a conventional batchwise operation or system, but on the other hand, the value distributes in a wide range in a continuous-flow operation.

Accordingly, in order to produce a pitch having a predetermined distribution of $k\theta$ value, the ratio of the reaction time with the flow operation type to the total time which is designated in the following should be changeable at any time in accordance with the kinds and the properties of the starting material, the petroleum residues.

The above-mentioned process conditions could not be attained by simply applying the known processes or systems of chemical engineering. For instance, the conventional batchwise operation or system is not able to fulfill the above-mentioned conditions (1) and (2), and on the other hand, the continuous flow operation or system is not able to fulfill the above-mentioned condition (3).

Thus, the principal object of the present invention is to offer a novel mass production system of a highly aromatic petroleum pitch, which is able to fulfill completely the above-mentioned process conditions.

As a result of further studies, it has now been found that the above-discussed technical problems can be solved by a novel pitch producing system including the steps of rapidly preheating a liquefied petroleum residuum to a temperature of 450°–520° C. by passing the same through a tubular heater(s) for 0.5–15 minutes, feeding the preheated residuum into a reaction vessel(s) and thermally cracking the same by introducing an inert gas heated to a temperature of 400°–2,000° C. through a heating furnace into the reaction vessel(s) for direct contact with the residuum for 0.5–10 hours during which the ratio of the number [l] of feeding flow line(s) which feed the preheated residuum from said tubular heater(s) into the reaction vessel(s) to the total number [m] of the reaction vessels is adjusted to be coincident with the ratio of the charging time [$\theta c$] required for charging one reaction vessel with one feeding flow of the preheated residuum to the total time [$\theta_T$] required for carrying out one batch of the thermal cracking in one reaction vessel, thereby realizing steady and continuous operations in the tubular heater(s) and in the heating furnace.

A better understanding of the present invention may be facilitated by referring to the accompanying drawings in which.

The heavy petroleum oils which can be used as the raw material for the present invention include various residues from an oil refinery such as, for example, atmospheric residue, vacuum residue, thermally cracked residue, oil extracted with Duo-Sol solvent, oil extracted with furfural and residues remaining after extraction of heavy oil by use of paraffinic solvents such as propane, butane and pentane. These raw materials may generally be liquefied by preheating to a temperature not higher than 200° C. so as to be transported and otherwise handled with increased ease. For example, asphalt which is the vacuum residue is liquefied by heating to 150°-180° C. and, in that stage, can be handled more easily at the time of transportation and storage.

Figure 1:
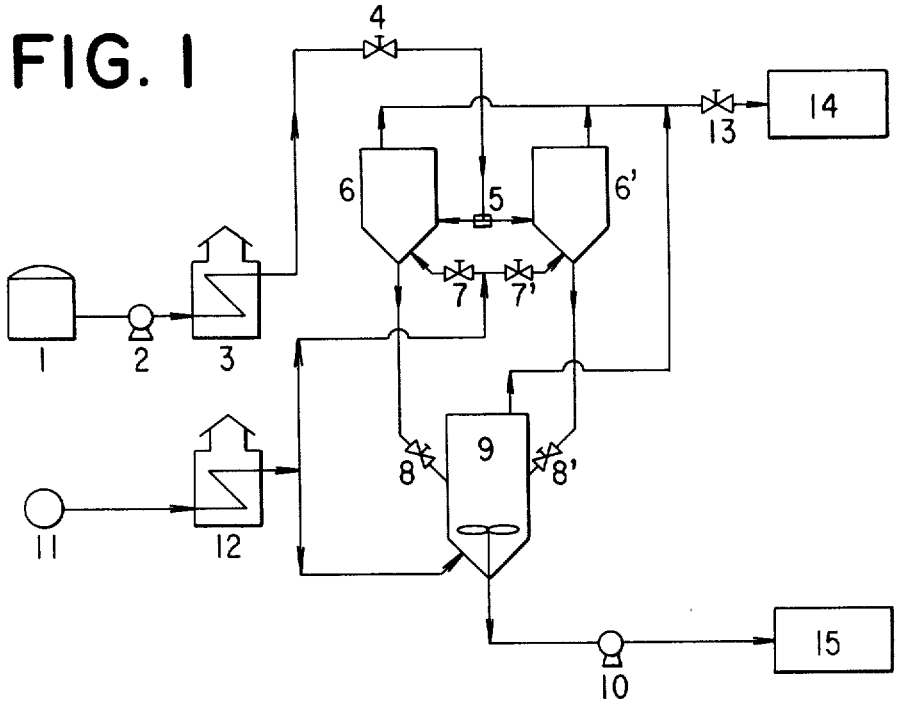
FIG. 1 is a flow sheet illustrating one embodiment of the pitch producing system according to the present invention.

Referring now to FIG. 1, the heavy petroleum oil as the raw material is kept in a raw-material tank 1 under atmospheric pressure (with the tank in an open state) at temperatures not higher than 200° C., generally in the range of 150°-180° C. From this tank, it is forwarded by a pump 2 into one tubular heater 3. In the tubular heater 3, the oil is rapidly heated from the level of 150°-180° C. to that of 450°-520° C., preferably 460°-500° C. This heating in the tubular heater 3 is effected under a pressure in the range of from the neighborhood of atmospheric pressure to 150 kg/cm$^2$G. for an approximate term of 0.5-15 minutes, preferably 2-5 minutes. In the course of this heating, the temperature rise up to 350° C. is thought to serve merely the purpose of preheating and generally 5-50% by weight of the raw material undergoes thermal cracking during the temperature rise from 350° to 450°-520° C. It has been ascertained through experiments that the reaction taking place inside the heating furnace 3 is predominantly that of thermal cracking and that a polycondensation occurs to a highly restricted extent. As to the significance of the temperature of 350° C., it has been demonstrated that the cracking reaction and the polycondensation of the raw oil hardly proceed at temperatures below this level and that the reactions suddenly proceed very readily at temperatures above this level. As a result, the time interval during which the temperature rise from 350° C. to 450°-520° C. is effected has an important significance; thus, this temperature rise should be made within the aforementioned range of time. The procedure and apparatus for the preheating from the storage temperature to about 350° C. are not specifically limited; those ordinarily adopted may be used for this purpose. For example, the tubular heater 3 may be partitioned into two parts, one to be used as the preheating zone and the other to be used as the reaction zone kept at temperatures over 350° C. If the tubular heater 3 is operated so that the temperature inside does not rise above 450° C. or the retention time of the oil under treatment in the heater 3 fails to reach 0.5 minute, then the desired thermal cracking does occur but insufficiently. If, on the other hand, the operations are such that the temperature exceeds 520° C., the retention time exceeds 15 minutes or the pressure rises to over 150 kg/cm$^2$G., then the thermal cracking proceeds excessively to the extent of causing an undesirable phenomenon of coking of the oil inside the tubes of the tubular heater 3.

The raw-material oil which has undergone a partial thermal cracking by the application of heat in the tubular heater 3 is successively introduced under the periodic flushing into the predetermined number of the reaction vessels 6, 6', . . . , with the flow volume thereof regulated by the regulating valve 4 and the switch valve 5 switched at the fixed intervals.

As previously summarized, it is essential in the present system that the ratio of the number [l] of feeding flow line(s) feeding the preheated residuum from said tubular heater 3 into the reaction vessel(s) 6, 6', . . . to the total number [m] of the reaction vessels is previously adjusted to be coincident with the ratio of the charging time [$\theta_c$] required for charging one reaction vessel with one feeding flow of the preheated residuum to the total time [$\theta_T$] required for carrying out one batch of the thermal cracking in one reaction vessel.

Figure 2:
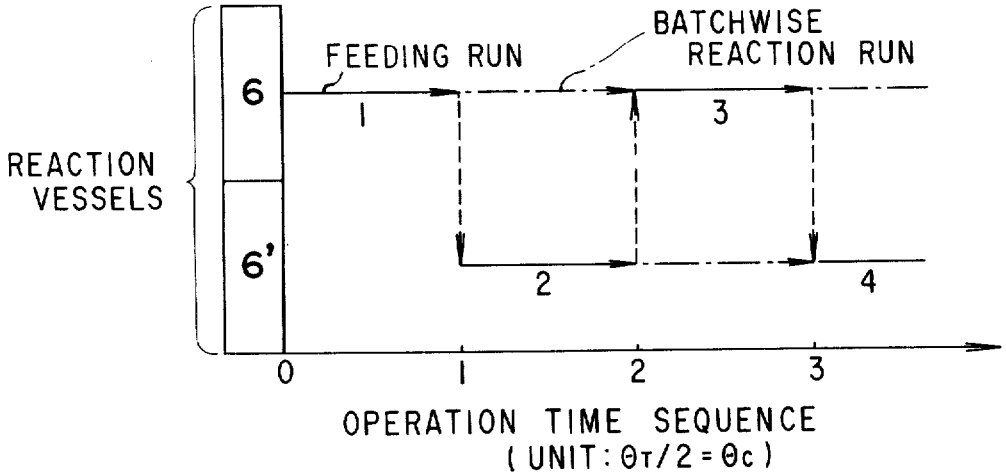
FIG. 2 is an operational diagram for carrying out the above-mentioned embodiment.

Accordingly, the flow sheet shown in FIG. 1 illustrates a case where the ratios of l:m and $\theta_c$:$\theta_T$ are both equal to 1:2. In this case where the introduction of the oil into the reaction vessel 6 is completed at the end of the time $\theta_c$, the switch valve 5 is immediately switched to start the delivery of the oil to the other reaction vessel 6' which has been readied for filling. Since this procedure is repeated, it follows that the raw-material oil is heated under constant conditions in the heating furnace in the steady operation and the heated raw-material oil is successively introduced into one of the two reaction vessels, thus enabling the thermal cracking treatment to be continuously carried out, as more clearly shown in the operational diagram of FIG. 2.

The reaction vessels 6 and 6' are generally cylindrical in shape and are each provided with an inlet for the raw material, an inlet for the gaseous heating medium, and outlets for cracked gas, cracked oil, the gaseous heating medium and the residue. The reaction vessels 6 and 6' may be additionally provided with an agitator as occasion demands.

Figure 3:
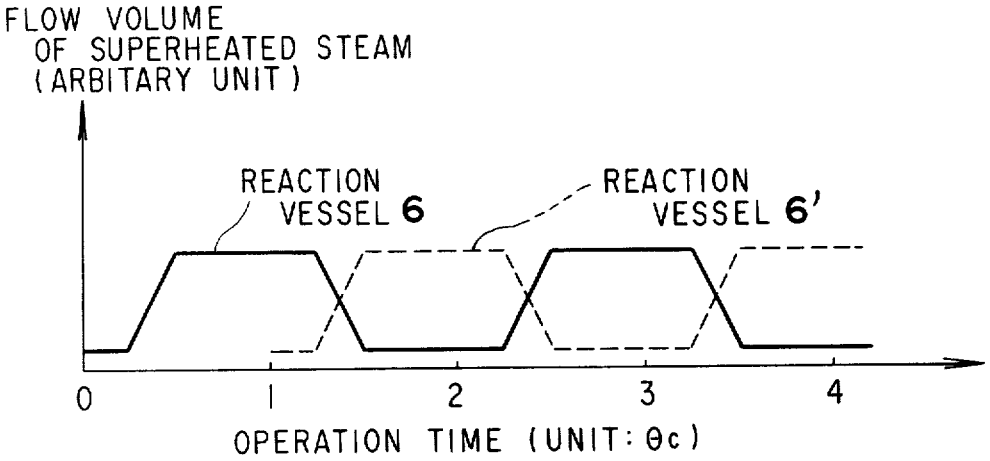
FIG. 3 is a flow diagram of the superheated steam corresponding to the operation in FIG. 2.

The inert gas 11 which serves as the gaseous heating medium is heated in the heating furnace 12 to 400°-2,000° C. and is blown via the regulating valves 7 and 7' into the reaction vessels 6 and 6'. In this case, the regulating valves are operated under a programmed control, and the heating furnace 12 for the gaseous heating medium is operated under constant conditions so that the sum of the flow volumes of the gaseous heating medium to the reaction vessels remains constant, as is shown in the gas flow diagram of FIG. 3. The gaseous heating medium for this treatment is an inert gas such as steam, nitrogen or argon or a complete-combustion gas containing substantially no oxygen.

Figure 4:
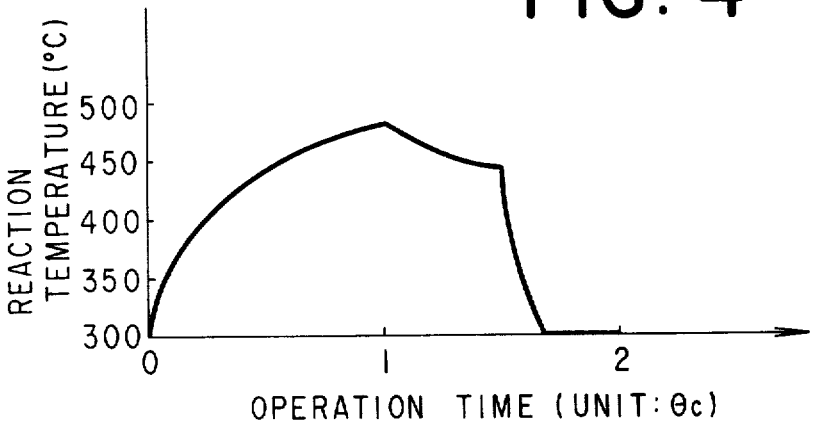
FIGS. 4 and 5 are the graphs illustrating the changes of the reaction temperature in (a) reaction vessel(s) and the changes of the softening point of the produced pitch corresponding to the operation in FIG. 2, respectively.

In most cases, the reaction vessels are kept at a temperature in the range of 320°-380° C. immediately prior to the filling with oil. At the same time when the filling of heavy petroleum oil is started, the temperature rises, as is shown in the graph of FIG. 4 and the cracking reaction continues to proceed and the polycondensation begins to occur. While the filling of the reaction vessel with the oil is in process, the reaction vessel is generally maintained at a temperature of 400°-440° C. In the meantime, the gaseous fraction of the product of thermal cracking is distilled out from the upper outlet in conjunction with the gaseous heating medium and then forwarded via the regulating valve 13 to the separation device 14. In consequence of the exhaust of the gaseous fraction, the polymerization of residual oil proceeds. By the time when the filling of the reaction vessel with the oil is completed, the softening point of the reacting residue becomes higher than that of the starting raw-material oil. After the completion of filling of the reaction vessel with the oil, the reaction is allowed to proceed further by continuing the introduction of the gaseous heating medium. In the meanwhile, the reaction temperature is gradually lowered. After the softening point of the pitch has reached a desired level, the reaction is substantially stopped by quenching the reaction vessel to a temperature in the range of 320°-380° C.

Figure 5:
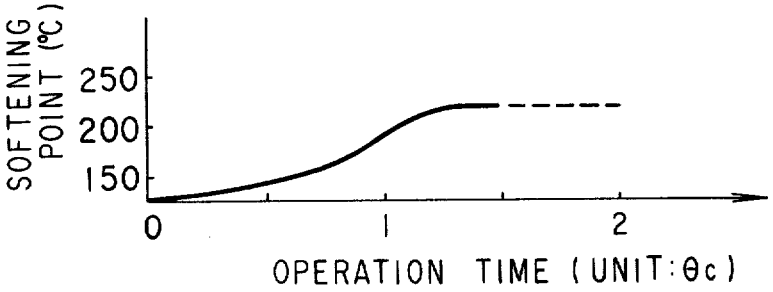

Typical data for illustrating the change of the softening point of the produced pitch are shown in FIG. 5.

Then, the pitch is at once transferred from the lower section of the reactor via the valve 8 (or 8') to the discharge tank 9. The discharge tank 9 is provided with an agitator which mixes uniformly the pitch received successively from the reaction vessels 6 and 6'. At the same time, superheated steam is introduced from the bottom section of the reaction vessel to keep the temperature within the discharge tank 9 in the range of 300°-370° C. and consequently maintain the pitch in its liquid state and strip the distillable fraction contained in the pitch.

The cracked gas and oil distilled from the reaction vessels 6 and 6' are forwarded in conjunction with the gaseous heating medium via the regulating valve 13 to the separation device 14 in which the cracked gas and oil are separated from each other by an conventional method. The pitch in the discharge tank 9 is withdrawn in its liquid state through the bottom section of the tank 9 and forwarded to the storage tank 15 by means of the pump 10.

By subjecting the heavy petroleum oil to the continuous thermal cracking treatment as described above, a small amount of thermally cracked gas and large amounts of thermally cracked oil and pitch can be produced. The thermally cracked gas is a gaseous product consisting mainly of hydrocarbons. The thermally cracked oil consists mainly of aliphatic hydrocarbons having ratios of number of hydrogen atoms to that of carbon atoms not less than 1.2 and this oil can readily be desulfurized to produce a fuel oil of low sulfur content. This thermally cracked oil can also be used as an oil having high economic value, finding utility in lubricating oils and as a raw material for catalytic cracking. The pitch consists of aromatic hydrocarbons having ratios of number of hydrogen atoms to that of carbon atoms not more than 1.0 and softening points ranging from 50°-250° C. The pitch has been shown by a infrared absorption spectrum and a nuclear magnetic resonance absorption spectrum to have high aromaticity. It has also been demonstrated by the solvent extraction test and the molecular weight determination that the pitch contains resinous components (those soluble in quinoline and insoluble in benzene) in a high concentration and contains coke in an extremely low concentration in spite of its high fixed carbon content. Since this pitch has a good compatibility with coal and enjoys a caking property and a high carbonizing coefficient, it is useful as the caking binder for weakly- or non-caking coal and is highly suitable for the production of coke for use in blast furnaces.

Figure 6:
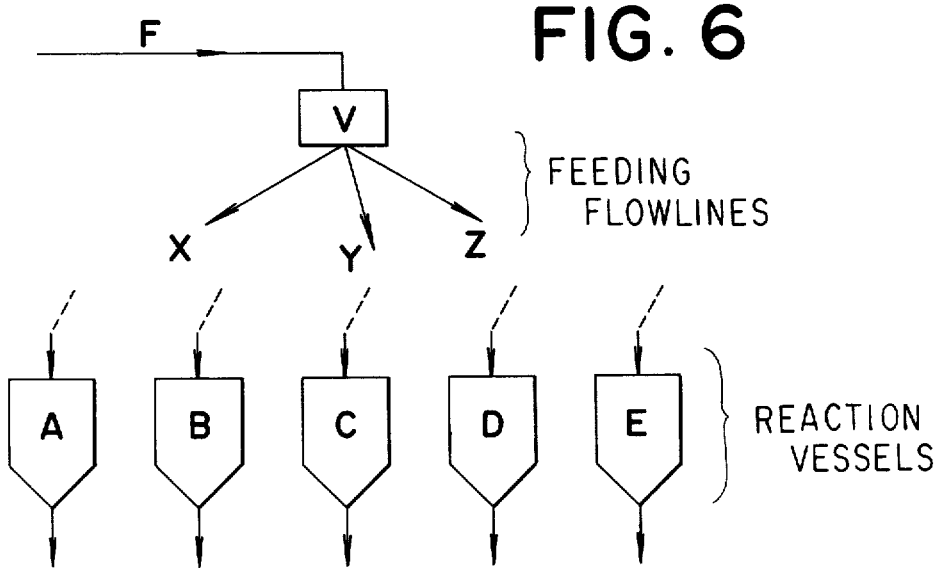
FIG. 6 is a flow sheet illustrating another embodiment of the present invention; and, FIG. 7 is an operational diagram for carrying out the above-mentioned embodiment.

By referring to FIGS. 5-7, another embodiment of the present invention is described in detail as follows;

In the flow sheet shown in FIG. 6, the flow F of the preheated petroleum residuum (the raw material) is divided into the three equal feeding flow lines X, Y and Z by the switching valve V. On the other hand, the number of the reaction vessels in this case is five as is illustrated in FIG. 6. Accordingly, this flow sheet explains the system of the present invention in the case where both the ratios l:m and $\theta_c$:$\theta_T$ are 3:5.

Figure 7:
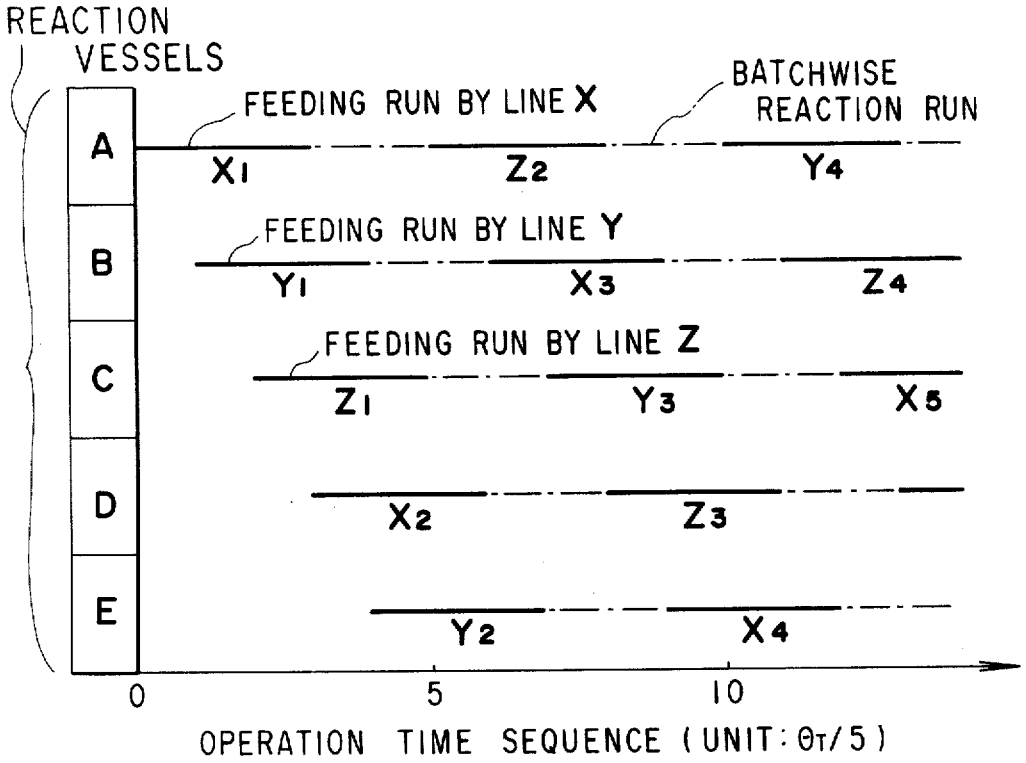

Referring to the operational diagram shown in FIG. 7, at the start of the operation, the feeding flow line X is directed to the reaction vessel A, and the preheated residuum is introduced into this vessel A in the time period of $\theta_c$ (Run $X_1$). The thermal cracking reaction is started simultaneously with the start of feeding of the residuum. Just after the completion of the feeding of the residuum into the reaction vessel A, the feeding flow line X is switched to the other reaction vessel D and so the preheated residuum is introduced into this reaction vessel D (Run $X_2$). While in the same time period, the other flow lines Y and Z are directed to the reaction vessels B and C, respectively, so as to introduce the heated residuum to the vessel B and C, respectively (Runs $Y_1$ and $Z_1$) in a time sequence in which each reaction is retarded relative to an earlier reaction by the unit time defined as the quotient of dividing the total operation time $\theta_T$ by the total number of the reaction vessels m.

Thereafter, three feeding flow lines X, Y and Z are directed to each of the reaction vessels A through E and the heated residuum is introduced at a certain constant period to each reaction vessels A through E in a cycle as is indicated in the operational diagram. That is, after within $\theta_T$ hours of the starting of the feeding of the residuum, one batch-operation in one reaction vessel is completely finished, and simultaneously with the finishing, the next feeding of the residuum to any one of the reacting vessels without any interruption may be started. Thus, the steady and continuous operation of the tubular heater is accomplished without any trouble.

Furthermore the time change of the total flow of superheated steam which is to be supplied from the heating furnace to all the operational system, as is seen in the operational diagram in FIG. 7, has at least a period of the unit time: $\theta_T/5$. In this case, the maintaining of the total flow rate of the heated inert gas steadily at a constant value is accomplished by the control for the time period of the unit time and so it is relatively easy. Thus, also the operation of the heating furnace may be carried out steadily and continuously and moreover, it becomes possible to effectively utilize the total amount of the heated inert gas therein in the above-mentioned thermal cracking reaction directly.

Moreover, the production efficiency of the total system is, in this case, becomes to one batch production-/one unit time. It is 5 times larger than that in the conventional batch operation.

The present invention will now be illustrated in detail with reference to the following Example.

EXAMPLE

The vacuum residue of Khafji crude oil and the equivoluminal mixture of the vacuum residues of Khafji crude oil and Irarian heavy crude oil were used as the raw material oils. The properties of the raw material oils were as shown in Table 1. Each raw material oil was preheated to 150° C. and stored in the tank, continuously fed at a flow rate of 300 kg/hour to the tubular type heating furnace (300 m in length and 10.9 mm in inside diameter) and heated therein to the various temperatures indicated in Table 2 for partial cracking. The heated raw material oil was then introduced to the reaction vessels in a system consisting of the predetermined number [m] of the reaction vessels through the switch valve for providing the predetermined number [l] of the feeding flow lines.

Each of the reaction vessel has dimensions of 5,000 mm in height and 450 mm in inside diameter and was provided at the bottom with an agitator which was operated to agitate the oil at a rate of 50 r.p.m.

Into one of the reaction vessels, the raw material oil was introduced during a prescribed term of charging time [$\theta_c$]. Thereafter, the oil was introduced into the subsequent reaction vessel. The total system was operated continuously by effecting cyclic switching, with the prescribed term of charging time [$\theta_c$] as the unit interval.

In each reaction vessel, the one batch operation was completed during the predetermined time [$\theta_T$]. The total flow volume of the superheated steam from the heating furnace was maintained at a constant value by the programmed control.

The cracked gas and the cracked oil were taken out from the top of the reaction vessel in conjunction with the superheated steam and were forwarded into the separation device where the cracked gas and oil were separated from each other.

From the bottom of the reaction vessel, the formed pitch was withdrawn into the discharge tank. In the discharge tank, the pitch withdrawn from the different reaction vessel were uniformly blended. At the same time, a superheated steam (at a temperature generally averaging 300°–380° C., a level lower than that of the superheated steam formerly introduced into the reaction vessels) was blown into the discharge tank to strip the volatile components from the blended pitch. Then, the pitch was removed from the system. Table 2 shows the conditions for the heat treatment, and the material balance data. Table 3 shows the properties of the cracked gas and the cracked oil (Since no appreciable difference was seen to occur in the properties of the cracked gas and the cracked oil within the range of operational conditions involved herein, only the typical data obtained with the mixture of the vacuum residues of Khafji crude oil and Iranian heavy crude oil are shown here.) Table 4 shows the properties of the pitch.

No coking trouble was observed to occur in any of the reaction vessel.

The thermal cracking reaction in the reaction vessels was carried out in a time sequence as retarded to each other by the unit time [$\theta_T$/m], thus, the operation in the tubular type heating furnace and also in the heating furnace for the steam could be easily carried out continuously and constantly.

The resultant cracked oil consisted of aliphatic hydrocarbons with H/C ratios ranged between 1.65 and 2.10. Having half as much sulfur content as the crude oil, this oil could be desulfurized easily.

The pitch was aromatic, as evidenced by its H/C ratio of as low as that in the range of 0.80–0.99. The softening point ranged from 121° to 195° C. These data clearly suggest that the properties of the pitch can be varied in a wide range by selecting the conditions of operation.

TABLE 1

| Properties of vacuum residue | | | Vacuum residue | |
|---|---|---|---|---|
| Properties | | Unit | Khafji crude oil | Mixture of the vacuum residues of Khafji crude oil and Iranian heavy crude oil (1:1) |
| Specific gravity (15° C./4° C.) | | — | 1.020 | 1.025 |
| Conradson carbon residue | | % by weight | 23.5 | 23.0 |
| Softening point | | °C. | 49.5 | 48.5 |
| Ash content | | % by weight | 0.17 | 0.15 |
| Penetration | | — | 72 | 78 |
| Elementary analysis | C | % | 83.5 | 83.2 |
| | H | % | 10.32 | 10.52 |
| | N | % | 0.31 | 0.57 |
| | S | % | 5.50 | 4.34 |
| | H/C | — | 1.47 | 1.51 |

TABLE 2

| Reaction conditions and mass balance | | | | | | | | | | | |
|---|---|---|---|---|---|---|---|---|---|---|---|
| No. | | | Unit | 1 | 2 | 3 | 4 | 5 | 6 | 7 | 8 | 9 |
| Raw oil (as the starting material) | | | — | Vacuum residue of Khafji crude oil | | | | Khafji crude oil / Iranian heavy crude oil | | | vacuum residue | |
| Number of feeding flow lines [l] | | | — | 1 | 1 | 1 | 3 | 1 | 1 | 1 | 1 | 3 |
| Number of reaction vessels [m] | | | — | 2 | 2 | 4 | 5 | 2 | 2 | 4 | 4 | 5 |
| Reaction conditions | | Charging time[$\theta_c$] | Minute | 120 | 90 | 60 | 120 | 120 | 90 | 60 | 45 | 120 |
| | | One batch operation time [$\theta_T$] | Minute | 240 | 180 | 240 | 200 | 240 | 180 | 240 | 180 | 200 |
| | Superheated steam | Flow rate (during charging) | kg/hour | 160 | 80 | 70 | 120 | 160 | 120 | 90 | 90 | 120 |
| | | Flow rate (after charging) | kg/hour | 40 | 20 | 20 | 20 | 40 | 40 | 30 | 30 | 20 |
| | | Temperature | °C. | 670 | 1000 | 800 | 600 | 650 | 1200 | 680 | 700 | 600 |
| | Tubular type heating furnace | Pressure at inlet | kg/cm²G | 37 | 30 | 37 | 35 | 37 | 27 | 37 | 37 | 35 |
| | | Pressure at outlet | kg/cm²G | 7 | 5 | 7 | 7 | 7 | 4 | 7 | 7 | 7 |
| | | Temperature at outlet | °C. | 495 | 480 | 495 | 495 | 495 | 460 | 495 | 495 | 495 |
| | | Retention time | Minute | 2.7 | 2.9 | 2.7 | 3.0 | 2.7 | 3.0 | 2.7 | 2.7 | 3.0 |
| | Reactor | Temperature | °C. | 430 ~410 | 435 ~415 | 430 ~400 | 430 ~400 | 430 ~412 | 432 ~418 | 418 ~395 | 436 ~405 | 430 ~400 |
| | | Pressure | kg/cm²G | 2.0 | 2.5 | 2.0 | 2.2 | 2.0 | 2.1 | 2.0 | 1.9 | 2.0 |
| Material balance | | | | | | | | | | | | |
| Yield | | Cracked gas | % by weight | 5.3 | 8.0 | 6.8 | 4.3 | 5.2 | 10.8 | 4.6 | 6.1 | 4.9 |
| | Cracked oil | Light oil | % by weight | 10.5 | 12.5 | 11.0 | 14.2 | 9.8 | 14.8 | 9.5 | 11.5 | 15.2 |
| | | Heavy oil | % by weight | 57.5 | 51.0 | 54.5 | 50.5 | 56.2 | 47.4 | 46.9 | 54.4 | 48.3 |
| | | Pitch | % by weight | 27.0 | 28.2 | 27.7 | 30.5 | 28.8 | 27.8 | 38.6 | 28.0 | 32.1 |

TABLE 3

Properties of cracked gas and cracked oil (Typical data obtained of mixture of vacuum residues of Khafji crude oil and Iranian heavy crude oil)

| Properties of cracked gas | | | | Properties of cracked oil | | | | Light oil | Heavy oil |
|---|---|---|---|---|---|---|---|---|---|
| Compositions | $H_2$ | % by volume | 6.4 | Properties | Specific gravity (15°/4° C.) | | — | 0.780 | 0.931 |
| | $CH_4$ | % by volume | 34.0 | | Conradson carbon residue | | % by weight | 0.02 | 1.30 |
| | $C_2H_6$, $C_2H_4$ | % by volume | 21.2 | | Kinematic viscosity | 100° F. | cst | 0.91 | 45.6 |
| | | | | | | 210° F. | cst | 0.54 | 5.1 |
| | $C_3H_8$, $C_3H_6$ | % by volume | 13.1 | | Distillation curve | Initial boiling point | °C. | 40 | 222 |
| | $C_4H_{10}$, $C_4H_8$ | % by volume | 10.2 | | | 10% | °C. | 77 | 266 |
| | $C_5H_{12}$ | % by volume | — | | | 50% | °C. | 147 | 397 |
| | | | | | | 95% | °C. | 219 | 520 |
| | $CO_2$ | % by volume | 0.32 | | Elementary analysis | C | % | 83.8 | 84.8 |
| | | | | | | H | % | 14.65 | 11.65 |
| | $H_2S$ | % by volume | 9.98 | | | N | % | 0 | 0.2 |
| | | | | | | S | % | 1.55 | 3.32 |
| Molecular weight | | | 29.2 | | | H/C | — | 2.10 | 1.65 |

TABLE 4

| | No. | | Properties of pitch 1 | 2 | 3 | 4 | 5 | 6 | 7 | 8 | 9 |
|---|---|---|---|---|---|---|---|---|---|---|---|
| Properties | Softening point* | °C. | 235 | 225 | 232 | 220 | 224 | 236 | 165 | 227 | 205 |
| | Fixed carbon | % by weight | 61.0 | 62.0 | 61.8 | 60.0 | 59.1 | 61.2 | 46.3 | 61.5 | 58.3 |
| | H/C | — | 0.81 | 0.82 | 0.80 | 0.80 | 0.83 | 0.81 | 0.99 | 0.83 | 0.80 |
| | Benzene-insolubles | % by weight | 57.5 | 56.3 | 54.0 | 52.0 | 53.8 | 54.5 | 35.9 | 53.0 | 50.0 |
| | Quinoline-insolubles | % by weight | 21.0 | 17.8 | 16.2 | 18.0 | 18.6 | 19.5 | 3.2 | 12.8 | 17.5 |

*Softening point - The temperature at which 1 g of the specimen placed in a KŌKA type flow tester using a nozzle 1 mm in diameter began to flow out of the nozzle when the tester was heated at a temperature rise rate of 6° C./min. under a load of 10 kg/cm$^2$.

What is claimed is:

1. In a pitch production by thermal cracking including the steps of rapidly preheating a liquefied petroleum residuum to a temperature of 450°-520° C. by passing the same through a tubular heater for 0.5-15 minutes, feeding said preheated residuum through a feed flow line into a reaction vessel and thermally cracking the same by introducing an inert gas heated to a temperature of 400°-2,000° C. through a heating furnace into said reaction vessel for a direct contact with the residuum for 0.5-10 hours; the improvement comprising: feeding said preheated residuum through a plurality of parallel feed flow lines into a plurality of reaction vessels, the ratio of the number of feeding flow lines feeding said preheated residuum from said tubular heater into said reaction vessels to the total number of said reaction vessels being adjusted to be coincident with the ratio of the charging time ($\theta$C) required for charging a reaction vessel with a feeding flow of said preheated residuum to the total time ($\theta$T) required for carrying out one batch of thermal cracking in a reaction vessel where the ratio $\theta T/\theta C$ is adjusted to be greater than 1, thereby realizing steady and continuous operations in said tubular heater and said heating furnace.

2. The pitch production of claim 1, wherein said petroleum residuum is selected from the group consisting of Duo-Sol extracts, furfural extracts, atmospheric residuums, vaccum residuums, and residuums obtained from paraffinic solvent extractions.

3. In a pitch production by thermal cracking including the steps of rapidly preheating a liquefied petroleum residuum to a temperature of 450°-520° C. by passing the same through a tubular heater for 0.5-15 minutes, feeding said preheated residuum through a feed flow line into a reaction vessel and thermally cracking the same by introducing an inert gas heated to a temperature of 400°-2,000° C. through a heating furnace into said reaction vessel for a direct contact with the residuum for 0.5-10 hours; the improvement comprising: feeding said preheated residuum through a plurality of parallel feed flow lines into a plurality of reaction vessels, the ratio of the number of feeding flow lines feeding said preheated residuum from said tubular heater into said reaction vessels to the total number of said reaction vessels being adjusted to be coincident with the ratio of the charging time ($\theta$C) required for charging a reaction vessel with a feeding flow of said preheated residuum to the total time ($\theta$T) required for carrying out one batch of the thermal cracking in a reaction vessel where the ratio $\theta T/\theta C$ is adjusted to be greater than 1, and a time sequence with each thermal cracking reaction in said reaction vessel being retarded relative to an earlier reaction by a unit time defined as the quotient obtained by dividing the total operation time ($\theta$T) by the total number of said reaction vessels, whereby the steady and continuous operation of the tubular heater and said heating furnace is realized and the total flow volume of the heated inert gas from said heating furnace remains constant during the pitch production.

* * * * *